US009056398B2

(12) United States Patent
Liao

(10) Patent No.: US 9,056,398 B2
(45) Date of Patent: Jun. 16, 2015

(54) KNIFE HAVING RESILIENT ELEMENTS FOR BLADE POSITIONING

(76) Inventor: Shun-Yi Liao, Yunlin County (TW)

( * ) Notice: Subject to any disclaimer, the term of this patent is extended or adjusted under 35 U.S.C. 154(b) by 451 days.

(21) Appl. No.: 13/415,101

(22) Filed: Mar. 8, 2012

(65) Prior Publication Data

US 2013/0174423 A1 Jul. 11, 2013

(30) Foreign Application Priority Data

Jan. 10, 2012 (TW) ..... 101100920 A

(51) Int. Cl.
*B26B 1/08* (2006.01)
*B26B 5/00* (2006.01)

(52) U.S. Cl.
CPC .. *B26B 1/08* (2013.01); *B26B 5/001* (2013.01)

(58) Field of Classification Search
CPC ..... B26B 5/001; B26B 1/08
USPC ..... 30/162, 151, 335
See application file for complete search history.

(56) References Cited

U.S. PATENT DOCUMENTS 3,439,419 A * 4/1969 Fleming ..... 30/162
4,592,140 A * 6/1986 Chasen ..... 30/123.7
5,023,996 A * 6/1991 Pape et al. ..... 30/144
5,025,557 A * 6/1991 Perreault ..... 30/151
6,775,911 B2 * 8/2004 Tremblay ..... 30/162
7,562,455 B2 * 7/2009 McHenry et al. ..... 30/162
7,574,804 B2 * 8/2009 Bezold et al. ..... 30/162
8,006,388 B1 * 8/2011 DeJesus ..... 30/152
2005/0193568 A1 * 9/2005 Peyrot et al. ..... 30/162
2006/0207102 A1 * 9/2006 Bezold et al. ..... 30/162
2007/0175045 A1 * 8/2007 McHenry et al. ..... 30/162
2009/0235534 A1 * 9/2009 Chu ..... 30/162
2010/0325899 A1 * 12/2010 Seber et al. ..... 30/162
2013/0081281 A1 * 4/2013 Chu ..... 30/162

* cited by examiner

*Primary Examiner* — Laura M Lee
(74) *Attorney, Agent, or Firm* — Bacon & Thomas, PLLC

(57) ABSTRACT

The present invention is to provide a knife including a blade and a handle, wherein the blade has a first end provided with a projection and two resilient elements, each resilient element has one end protrudingly provided with an engaging portion, and the handle has a receiving space for receiving the blade and has a first track and two second tracks provided longitudinally thereon. The projection can be movably inserted in the first track. The distance between each pair of the corresponding ends of the second tracks corresponds to the distance between the engaging portions. Thus, when the engaging portions are respectively engaged in a pair of the corresponding ends of the second tracks, the engaging portions cannot move along the second tacks, such that either the blade is completely received and positioned in the handle, or a second end of blade is extended and positioned outside the handle.

19 Claims, 10 Drawing Sheets

KNIFE HAVING RESILIENT ELEMENTS FOR BLADE POSITIONING

FIELD OF THE INVENTION

The present invention relates to a knife, more particularly to a knife including a blade having a first end provided with two resilient elements, wherein each of the resilient elements has one end protrudingly provided with an engaging portion. Thus, when the engaging portions are respectively engaged in a pair of corresponding ends of two second tracks longitudinally provided on the handle, the engaging portions cannot move along the second tacks such that either the blade is completely received and positioned in the handle, or a second end of blade is extended and positioned outside the handle.

BACKGROUND OF THE INVENTION

Recently, with the advancement of craft techniques and the improvement of living standards, people who intend to buy a new product consider not only the price and durability of the product, but also whether the product is convenient and safe to use. Such a change in market trends has driven manufacturers and designers in all fields to develop new and better products on a regular basis so as to meet consumers' needs.

Take the assisted-opening folding knives typically used in outdoor recreational activities for example. Referring to FIG. 1, the assisted-opening folding knife 1 has a blade 11 pivotally connected in a handle 12. The blade 11 can be rotated into and received in the handle 12 so that the knife 1 can be carried around. To use the knife 1, the user must push the exposed lateral side of the blade 11 outward so that the blade 11 rotates automatically and is positioned outside the handle 12. While the assisted-opening folding knife 1 is very common in the market, its structure has certain drawbacks as detailed below:

(1) Low smoothness of operation: To use the assisted-opening folding knife 1, the blade 11 must be actuated to rotate at least 180 degrees so as to extend out of the handle 12. However, the longer the rotation path of the blade 11 is, the more the time and space required will be. Therefore, despite improvements made to the actuating mechanism, operation of the knife 1 is still not smooth and intuitive enough. Moreover, for those who are not familiar with the use of knives, the large rotation of the blade 11 tends to cause cut injury to the hand, which raises safety issues in use. Because of the above, assisted-opening folding knives like the knife 1 have yet to be extensively used.

(2) Structural complexity: As previously mentioned, the industry has made improvements to the structure of the assisted-opening folding knife 1 to enhance smoothness of use. Nevertheless, the improved structure is often a very complicated one because the design of the internal structure of the knife 1 must also take into account the positioning stability of the blade 11, the rotation space of the blade 11, and the way in which and the position at which the blade 11 is to be pushed. Consequently, not only is production cost increased, but also the durability of the knife is impaired.

Therefore, the issue to be addressed by the present invention is to design a knife having a novel structure in which the space required for driving out the blade is minimized, thus increasing the smoothness of operation of the knife while the convenience of use and durability of the knife are ensured.

BRIEF SUMMARY OF THE INVENTION

In view of the fact that the angle over which the blade of a conventional assisted-opening folding knife must rotate in order to extend out is so large that smoothness of operation cannot be further improved, the inventor of the present invention put years of practical experience into extensive research and experiment and finally succeeded in developing a knife having resilient elements for blade positioning as disclosed herein. It is hoped that the present invention will provide the general public with a novel tool which is more convenient and easy to use.

It is an object of the present invention to provide a knife having resilient elements for blade positioning, wherein the knife includes a blade, a handle, and a pushing element. The blade has a first end provided with a projection and two resilient elements. Each resilient element has one end protrudingly provided with an engaging portion. The handle corresponds in configuration to the blade so as for the blade to be positioned in a receiving space in the handle. The handle is provided longitudinally therein with a first track and two second tracks. The first track corresponds in position to the projection, thus allowing the projection to be movably inserted in the first track. The second tracks correspond in position to the resilient elements respectively, and the distance between each pair of the corresponding ends of the second tracks corresponds to the distance between the engaging portions. The engaging portions, when respectively engaged in a pair of the corresponding ends of the second tracks, cannot move along the second tacks such that either the blade is completely received and positioned in the handle or a second end of blade is extended out of a front opening of the handle and positioned outside the handle. The pushing element has one end exposed from the handle and the opposite end extending into the handle and movably inserted in the first track. The pushing element has two recesses each corresponding in position to one of the engaging portions so as for the engaging portions to be positioned in the recesses respectively. Each recess has an obliquely extending wall on each side. When the engaging portions are respectively engaged in a pair of the corresponding ends of the second tracks and the pushing element is moved along the first track, the engaging portions are respectively pushed by the obliquely extending walls that are located away from the direction in which the pushing element is moved. Consequently, the resilient elements are deformed, and the distance between the engaging portions is adjusted to correspond to the distance between the middle sections of the second tracks, thus allowing the engaging portions to move respectively along the middle sections of the second tracks until the engaging portions are engaged in the opposite pair of the corresponding ends of the second tracks respectively. As the distance between the engaging portions is greater (or less) than the distance between the middle sections of the second tracks, the blade can be securely received in the handle or positioned outside the handle without longitudinal displacement. In addition, due to the resilience of the resilient elements, a user only has to push the pushing element along the first track, and the resilient elements together with the engaging portions thereof will be deformed to enable displacement of the first end of the blade along the second tracks, so as for the blade to extend out of the front opening or be received in the handle from the front opening.

BRIEF DESCRIPTION OF THE SEVERAL VIEWS OF THE DRAWINGS

The structure as well as a preferred mode of use, further objects, and advantages of the present invention will be best understood by referring to the following detailed description of some illustrative embodiments in conjunction with the accompanying drawings, in which.

DETAILED DESCRIPTION OF THE INVENTION

Figure 1:
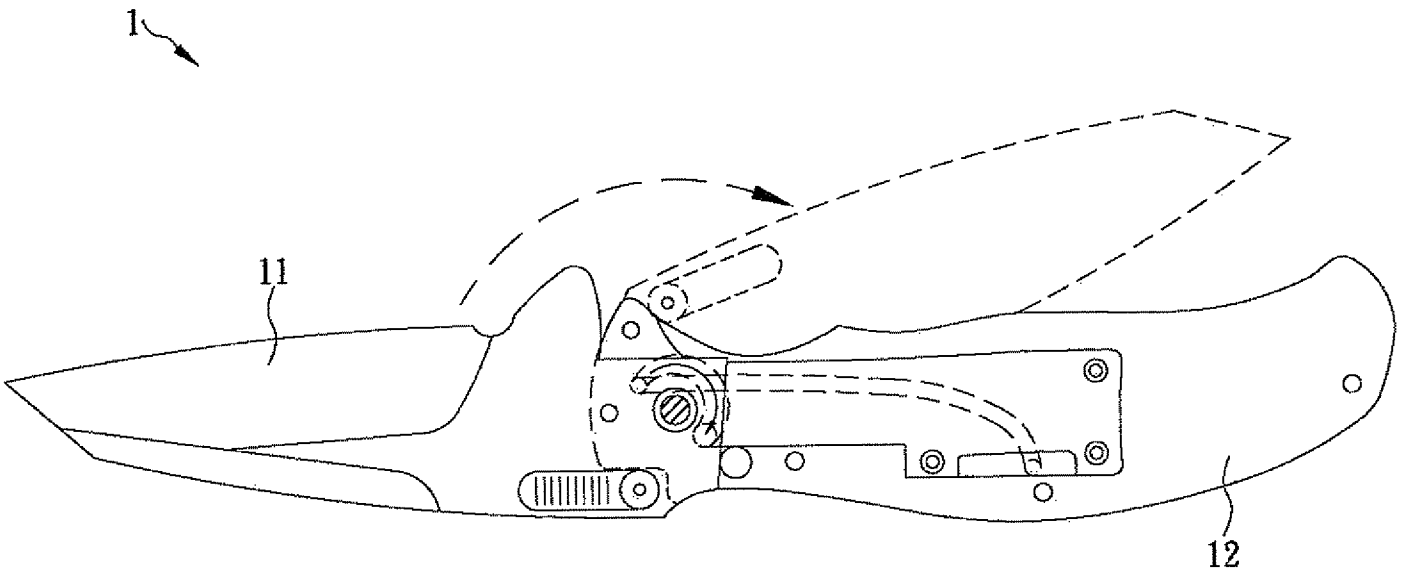
FIG. 1 (Prior Art)
FIG. 1 schematically shows a conventional assisted-opening folding knife.

The present invention discloses a knife having resilient elements for blade positioning. Please refer to FIG. 2 for the first preferred embodiment of the present invention. The knife 2 includes a blade 21, a handle 22, and a pushing element 23. The end of the blade 21 that is away from the blade tip is provided with two resilient elements 210 that extend outward. The very end of the blade 21 is also extendedly provided with at least one projection 211 on each of the top side and the bottom side. Each resilient element 210 has one end protrudingly provided with two engaging portions 210*a* that extend upward and downward respectively. In this embodiment, the engaging portions 210*a* on the same side of the resilient elements 210 are spaced by a distance less than the distance between the middle sections of the resilient elements 210. The handle 22 is composed of an upper housing 220, a first plate 221, a middle housing 222, a second plate 223, and a lower housing 224. The middle housing 222 is formed with a front opening 222*b* at one end such that a receiving space 222*a* is formed in the middle housing 222. The first plate 221 is fixedly provided on an inner side of the upper housing 220, and the second plate 223 is fixedly provided on an inner side of the lower housing 224. Once the housings 220, 222, and 224 are fastened together, the blade 21 can be received in the receiving space 222*a*.

Figure 2:
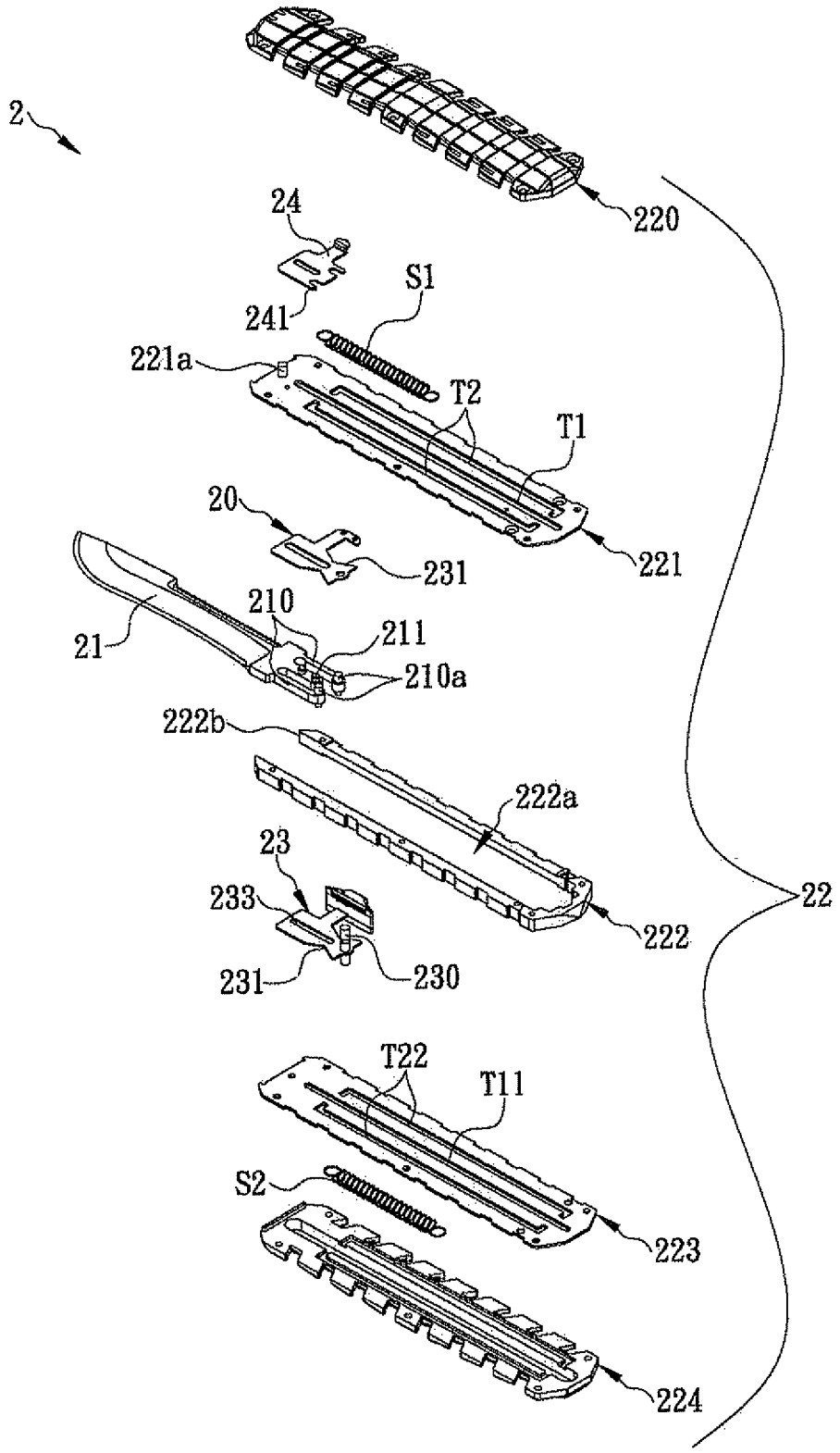
FIG. 2 is an exploded perspective view of a knife according the first preferred embodiment of the present invention.
Figure 3:
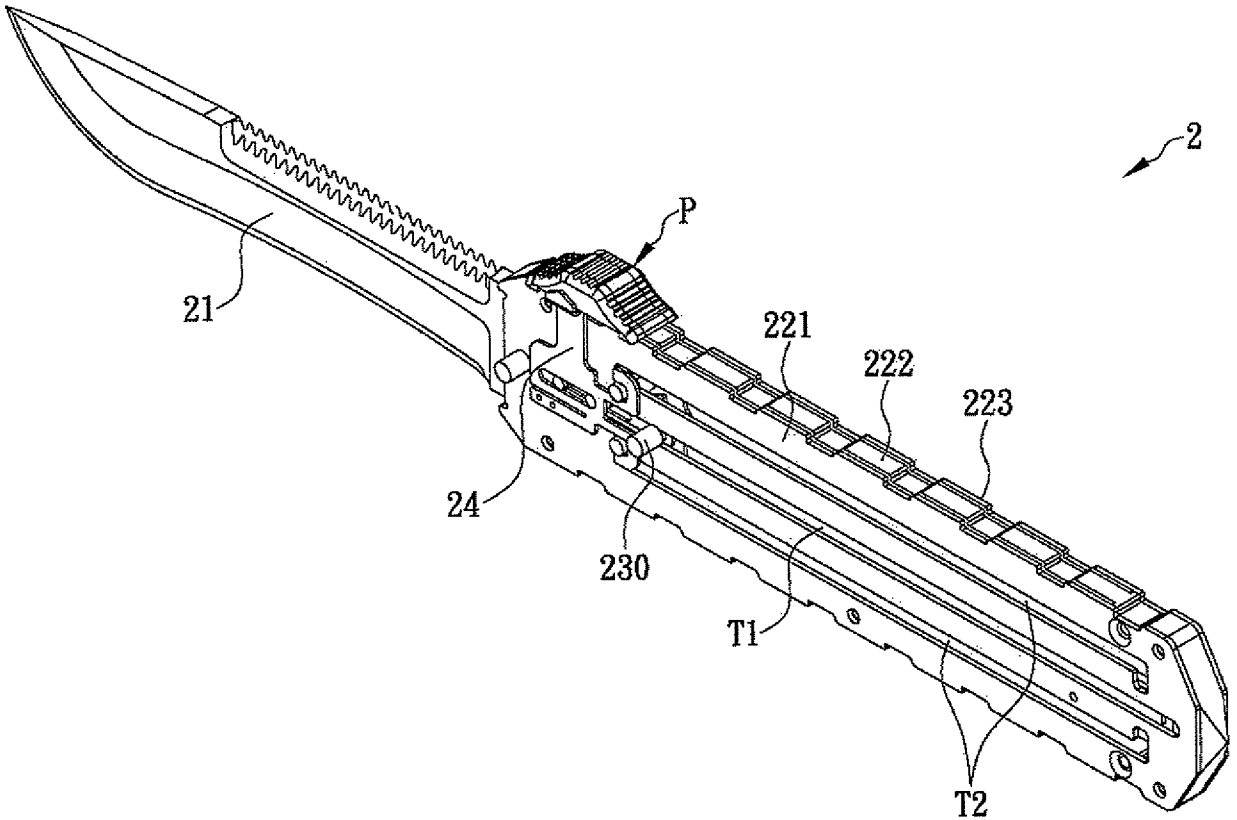
FIG. 3 is an assembled perspective view of the knife according to the first preferred embodiment of the present invention.

As shown in FIGS. 2 and 3, the side of the first plate 221 that faces the receiving space 222*a* is longitudinally formed with a first track T1 and two second tracks T2. The projections 211 on the top side of the blade 21 are movably inserted in the first track T1. The distance between each pair of the corresponding ends of the second tracks T2 corresponds to the distance between the engaging portions 210*a* on the same side of the resilient elements 210 (hereinafter also referred to as the same-side engaging portions 210*a*), and the distance between the middle sections of the second tracks T2 is greater than the distance between the same-side engaging portions 210*a*. Therefore, when the engaging portions 210*a* facing the first plate 221 are respectively engaged in a pair of the corresponding ends of the second tracks T2, the engaging portions 210*a* cannot move along the second tracks T2. As a result, the blade 21 either is positioned in the handle 22 or is extended out of the front opening 222*b* and positioned outside the handle 22.

Referring to FIGS. 2 and 3, the pushing element 23 is positioned between the middle housing 222 and the second plate 223. The pushing element 23 has a first end exposed from the handle 22 and a second end extending into the handle 22 and corresponding in position to the receiving space 222*a*. The second end of the pushing element 23 is provided with at least one post 230 which extends outward and which is movably inserted in the first track T1. The pushing element 23 is provided with two recesses 231 that correspond in position respectively to the engaging portions 210*a* facing the pushing element 23 so as for these engaging portions 210*a* to pass through and be positioned in the recesses 231 respectively. It should be pointed out that the pushing element 23 in this embodiment further includes an auxiliary plate 20. The auxiliary plate 20 is positioned between the first plate 221 and the middle housing 222 and has a first end connected to the first end of the pushing element 23; thus, the auxiliary plate 20 is movable along with the pushing element 23. The auxiliary plate 20 is also provided with two recesses 231 that correspond in position respectively to the engaging portions 210*a* facing the auxiliary plate 20. Therefore, when the blade 21 is being actuated, the force to which the blade 21 is subjected is more evenly distributed than without the auxiliary plate 20.

Figure 4A:
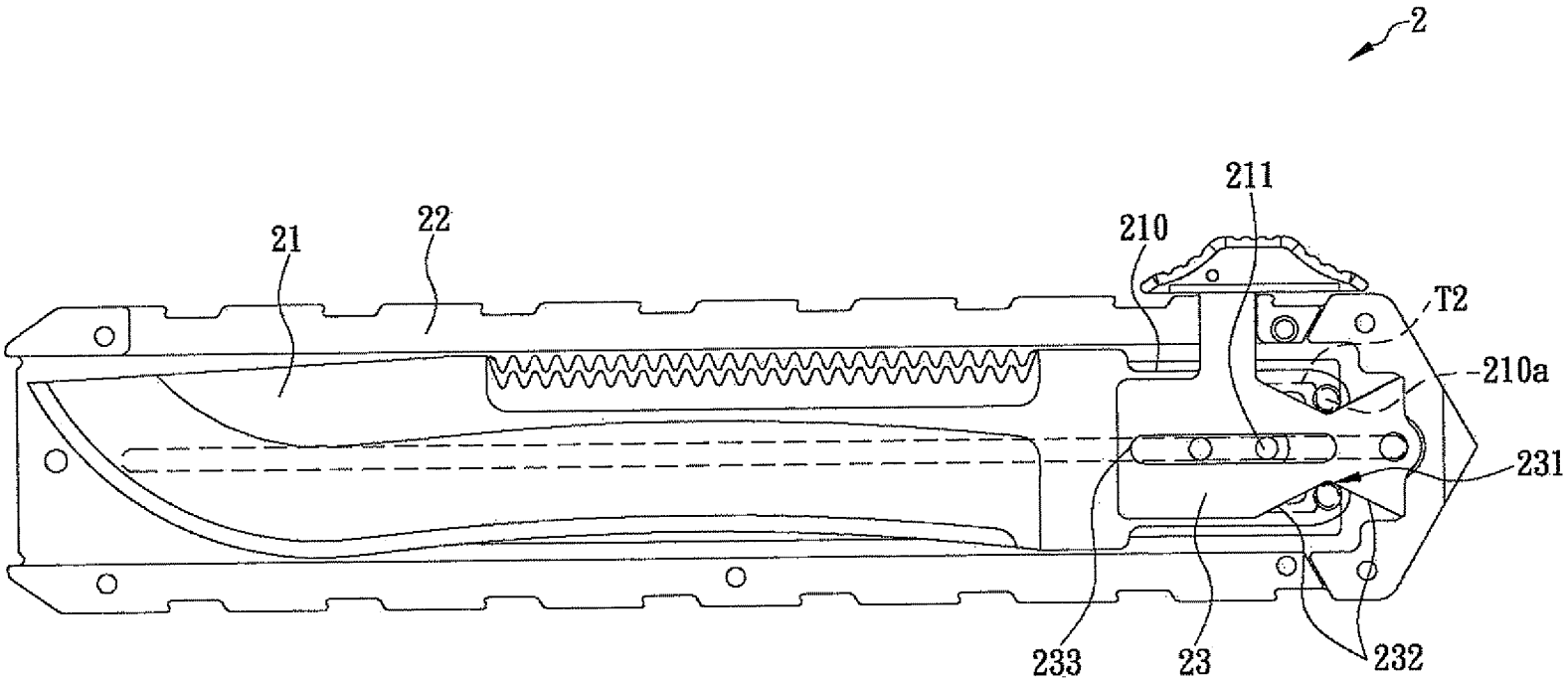
FIG. 4A schematically shows operation of the knife according to the first preferred embodiment of the present invention.

Reference is now made to FIG. 4A in conjunction with FIG. 2. The blade 21 in FIG. 4A is received in the handle 22 while the engaging portions 210*a* facing the first plate 221 are engaged in the rear ends of the second tracks T2 respectively. Each recess 231 has an obliquely extending wall 232 on each side. The end of each obliquely extending wall 232 that is away from the corresponding recess 231 is on the same horizontal level as the middle section of the corresponding second track T2. Hence, referring to FIGS. 4A and 4B, when the pushing element 23 is moved along the first track T1 by pushing the first end of the pushing element 23, the engaging portions 210*a* facing the first plate 221 are respectively pushed by the obliquely extending walls 232 of the pushing element 23 that are located away from the direction in which the pushing element 23 is moved (i.e., the obliquely extending walls 232 on the right as shown in FIG. 4A). As a result, the engaging portions 210*a* facing the first plate 221 are respectively and obliquely moved along the corresponding obliquely extending walls 232, causing deformation of the resilient elements 210, and the distance between those engaging portions 210*a* is increased. Once the distance between those engaging portions 210*a* is adjusted by the corresponding obliquely extending walls 232 to correspond to the distance between the middle sections of the second tracks T2 (see FIG. 4B), those engaging portions 210*a* are allowed to move along the second tracks T2.

Figure 4B:
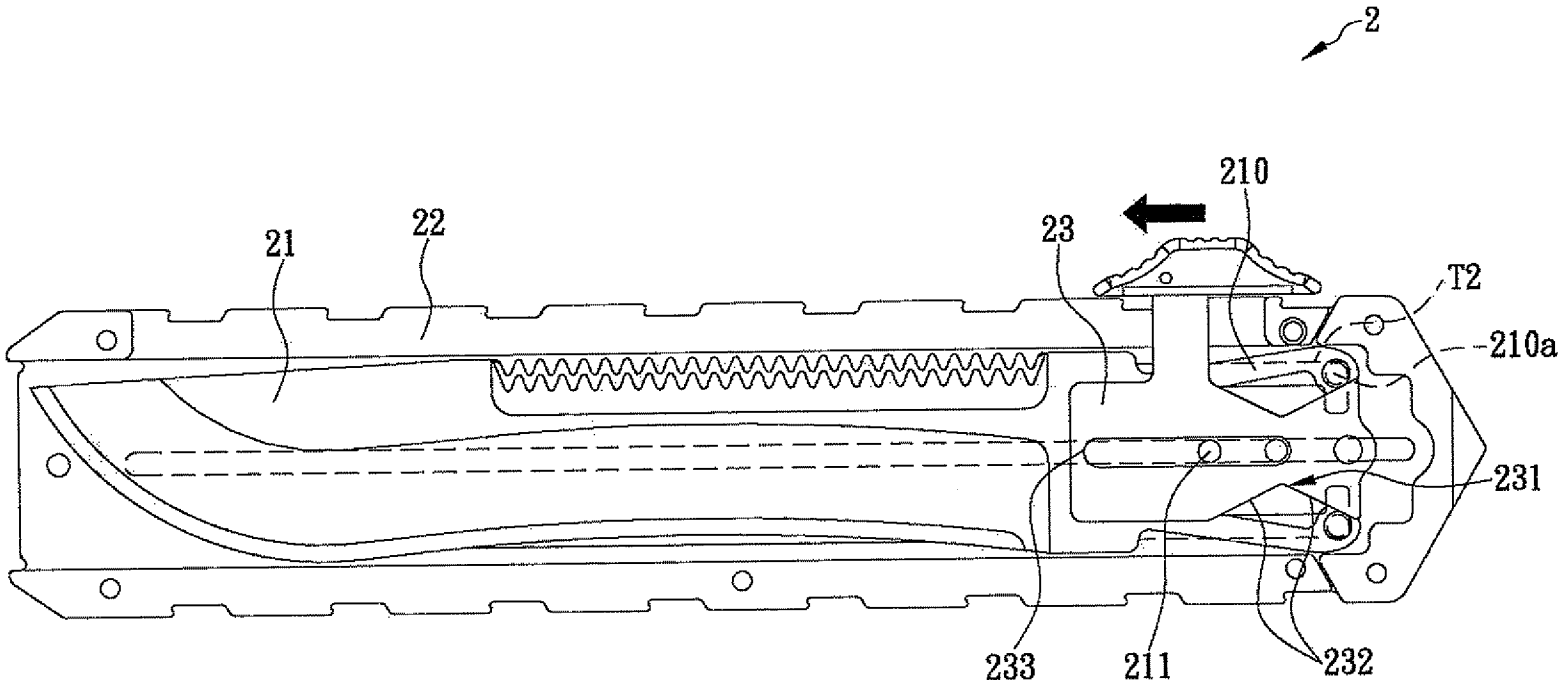
FIG. 4B schematically shows operation of the knife according to the first preferred embodiment of the present invention.
Figure 4C:
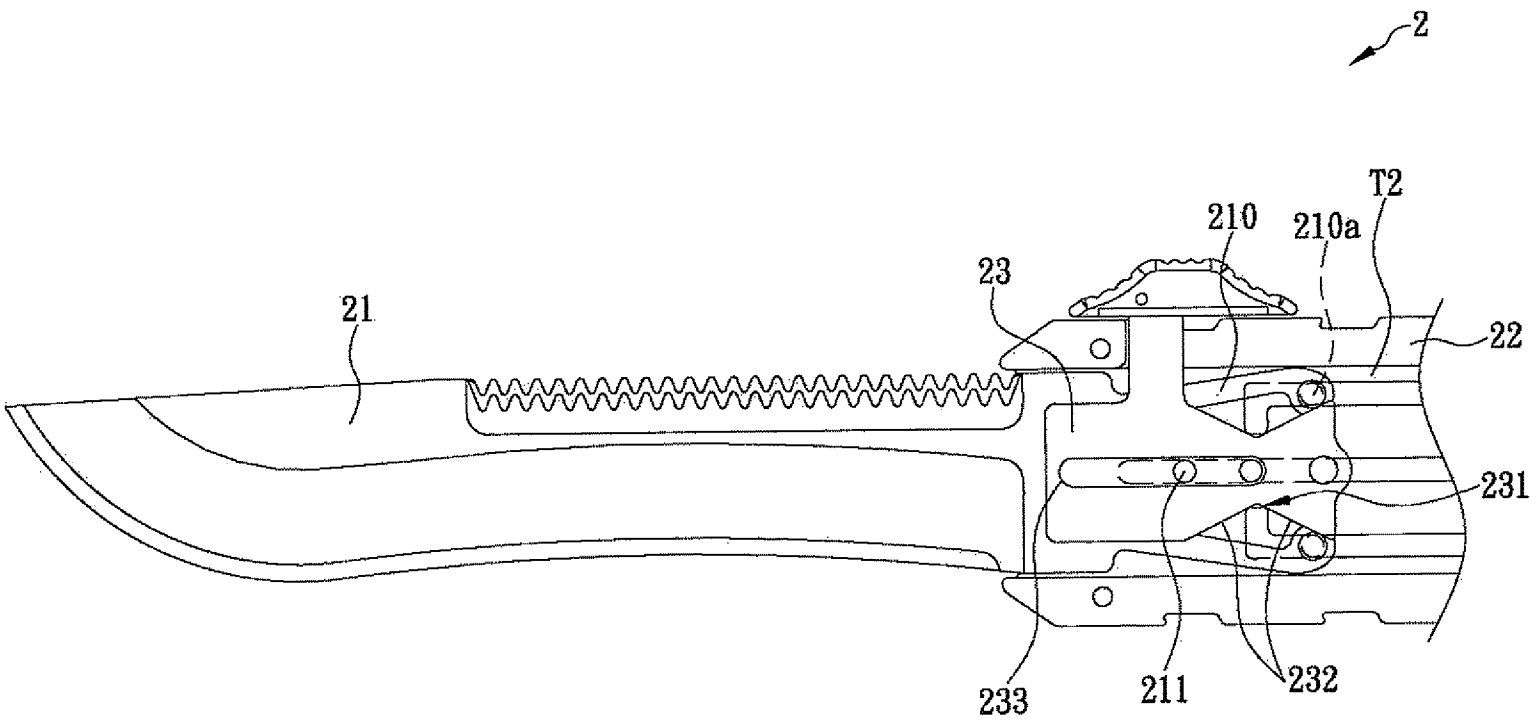
FIG. 4C schematically shows operation of the knife according to the first preferred embodiment of the present invention.
Figure 4D:
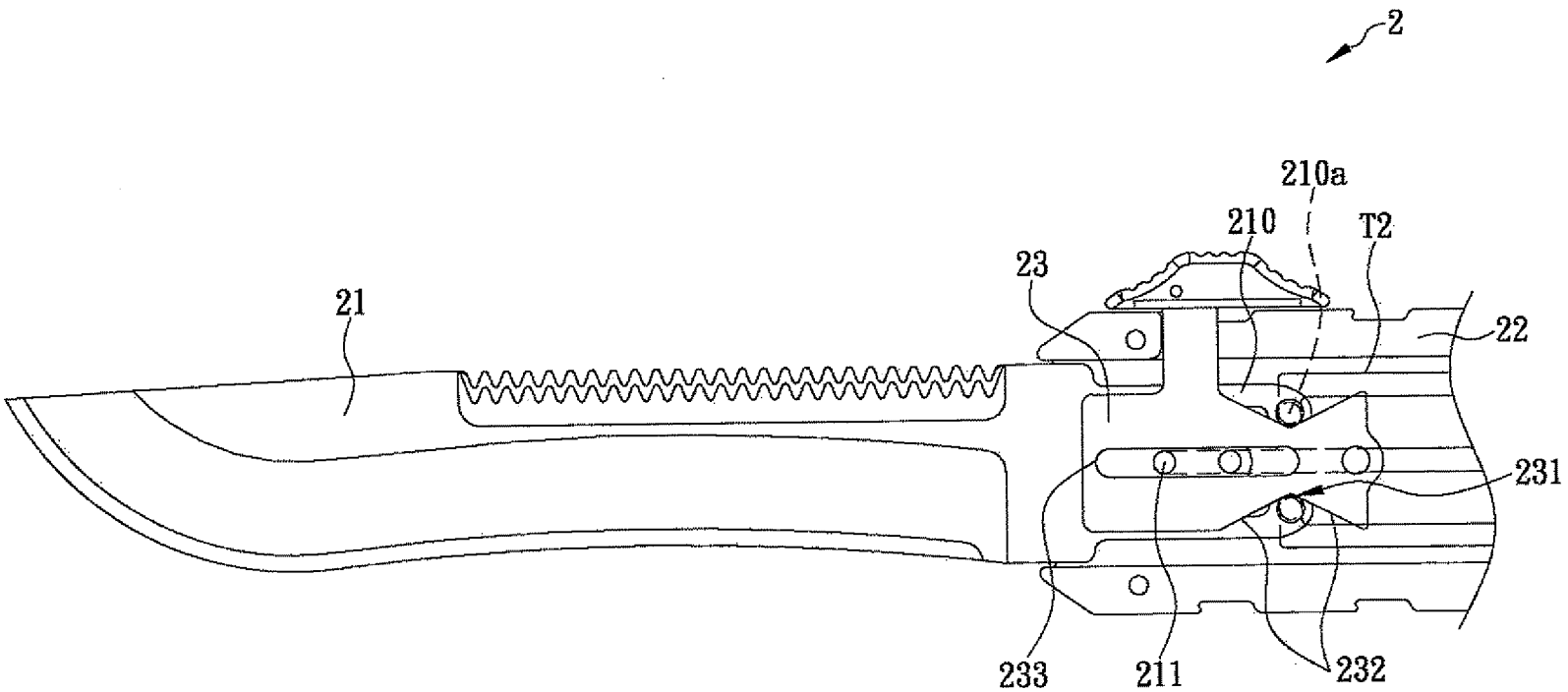
FIG. 4D schematically shows operation of the knife according to the first preferred embodiment of the present invention.

Referring to FIGS. 4C and 4D, after the engaging portions 210*a* facing the first plate 221 are moved along the second tracks T2 to the front ends thereof respectively, these engaging portions 210*a* are brought close to each other by the resilient restoring force of the resilient elements 210. More specifically, these engaging portions 210*a* are respectively brought back into the corresponding recesses 231 along the second tracks T2 and are respectively engaged in the front ends of the second tracks T2 (see FIG. 4D). Thus, the blade 21 is securely positioned outside the handle 22 for use. By the same token, when it is desired to retract the blade 21 into the handle 22, the user only has to push the pushing element 23 toward the rear ends of the second tracks T2, and the resilient elements 210 will be deformed, thus allowing the engaging portions 210*a* facing the first plate 221 to move along the second tracks T2 and be positioned at the rear ends of the second tracks T2 respectively.

Referring to FIG. 2 and FIGS. 4A to 4D, in the first preferred embodiment of the present invention, the pushing element 23 is concavely provided with a positioning groove 233 adjacent to the recesses 231. The positioning groove 233 corresponds in configuration to the projections 211 facing the pushing element 23 so as for the projections 211 to be inserted into the first track T1 after passing through the positioning groove 233, wherein the projections 211 are movably inserted through the positioning groove 233. As shown in FIG. 4B, when the pushing element 23 is moved along the first track T1 such that the right hand-side obliquely extending walls 232 in the drawing push the engaging portions 210*a* respectively, the rear projection 211 is pressed against the rear end of the positioning groove 233 to prevent the engaging portions 210*a* from moving beyond the obliquely extending walls 232. Thus, the blade 21 is prevented from being freed from the control of the pushing element 23. To achieve this end, the distance by which each projection 211 can be moved toward the adjacent end of the positioning groove 233 is, in this embodiment, less than the distance between each recess 231 and the distant end of either of its obliquely extending walls 232.

Referring again to FIG. 2, in this embodiment, the second plate 223 is positioned between the middle housing 222 and the lower housing 224. Besides, the second plate 223 is provided with a first auxiliary track T11 corresponding in position and configuration to the first track T1 and two second auxiliary tracks T22 corresponding in position and configuration to the second tracks T2 respectively. The pushing element 23 is movably inserted in the first auxiliary track T11 and can move along the first auxiliary track T11. The engaging portions 210*a* of the blade 21 that face the second plate 223 are movably inserted in and can move along the second auxiliary tracks T22 respectively. Thus, while the blade 21 is moved forward or backward, the force applied to the blade 21 is more evenly distributed, and the blade 21 is less likely to derail, wobble, or shake than without the auxiliary tracks.

Figure 5:
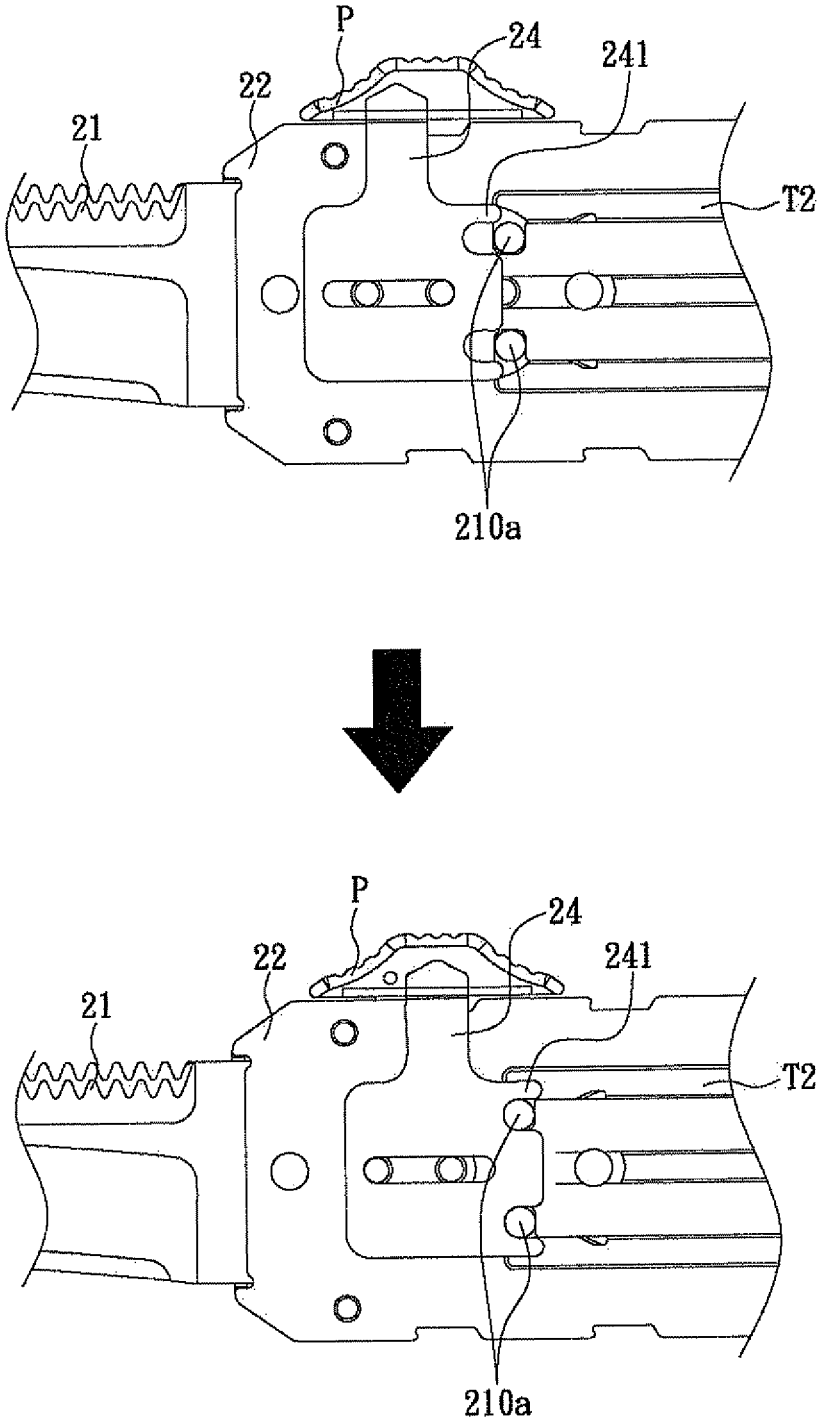
FIG. 5 is a partial view of a knife according to the second preferred embodiment of the present invention.

Referring to FIGS. 2, 3, and 5, the knife 2 according to the second preferred embodiment of the present invention further includes a pushing key P and a positioning element 24. The pushing key P has one end connected to the first end of the pushing element 23 and the first end of the auxiliary plate 20. The positioning element 24 is movably inserted between the upper housing 220 and the first plate 221 and has one end exposed from the handle 22 and the opposite end extending to a position adjacent to the engaging portions 210*a*. The positioning element 24 is provided with two retaining portions 241 which correspond in position respectively to the engaging portions 210*a* facing the positioning element 24 and which correspond in configuration to the cross section of each of those engaging portions 210*a*. When the blade 21 has been extended out of the handle 22 and the engaging portions 210*a* facing the positioning element 24 are respectively positioned at the front ends of the second tracks T2, the positioning element 24 can be moved along the longitudinal direction of the handle 22 so that the retaining portions 241 engage with the engaging portions 210*a* respectively. By means of the retaining portions 241, the distance between, and hence the relative positions of, those engaging portions 210*a* can be fixed to ensure that the blade 21 will not be retracted into the handle 22 by accident even if the pushing element 23 is inadvertently pushed while the knife 2 is being used. Consequently, the danger of accidental retraction of the blade 21 is avoided. It is also feasible for the first plate 221 to have a steel ball adjacent to the front end of the first plate 221, and for the positioning element 24 to be concavely provided with at least one cavity corresponding in position to the steel ball. Thus, when the blade 21 has been extended out of the handle 22 and the retaining portions 241 of the positioning element 24 are respectively engaged with the corresponding engaging portions 210*a*, the steel ball on the first plate 221 is engaged in the corresponding cavity to secure the positioning element 24 at a position where the corresponding engaging portions 210*a* are engaged with the positioning element 24. As a result, the positioning stability of the blade 21 is further ensured.

It should be pointed out that, in the previous embodiments, the distance between the engaging portions 210*a* on the same side of the resilient elements 210 is less than the distance between the resilient elements 210, and the distance between each pair of the corresponding ends of the second tracks T2 is less than the distance between the middle sections of the second tracks T2; however, the configurations of the engaging portions 210*a* and of the second tracks T2 are not limited to the foregoing and may be designed as needed. In another preferred embodiment of the present invention, the distance between the same-side engaging portions 210*a* is greater than the distance between the resilient elements 210, and adjustments are made to the second tracks T2 and the pushing element 23 accordingly such that the working principle and operation of the knife 2 remain unchanged.

In the embodiment shown in FIG. 2, the knife 2 further includes a first spring S1 and a second spring S2. The first spring S1 has one end connected to a fixing post 221*a* provided at the front end of the first plate 221. The other end of the spring S1 is connected to the post 230 on the top side of the pushing element 23. Likewise, the second spring S2 has one end connected to the second plate 223 and the other end connected to the post 230 on the bottom side of the pushing element 23. When the blade 21 is completely received in the handle 22, the springs S1 and S2 are stretched and under tension. If, in this state, the pushing element 23 is moved along the longitudinal direction of the handle 22 such that the engaging portions 210*a* facing the first plate 221 are disengaged from the rear ends of the second tracks T2, the blade 21 will be driven toward the front opening 222*b* by the resilient restoring force of the springs S1 and S2 and therefore rapidly extended out of the handle 22 precisely as designed.

Figure 6:
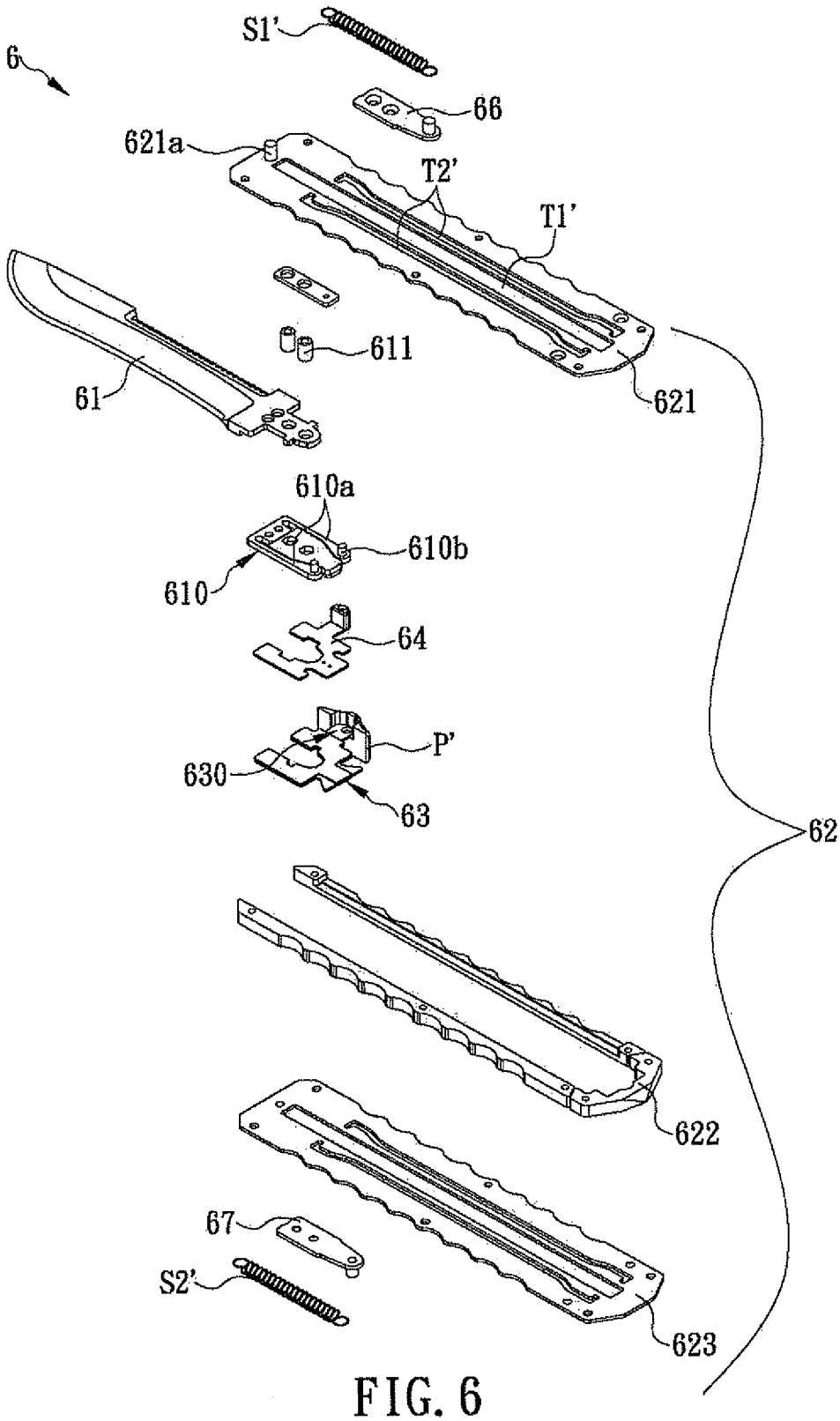
FIG. 6 is an exploded perspective view of a knife according to the third preferred embodiment of the present invention.
Figure 7:
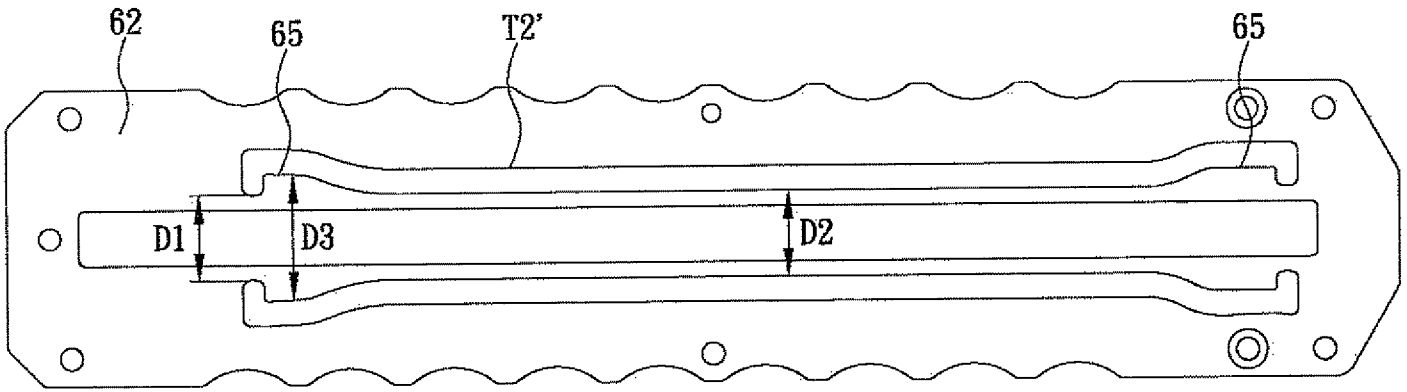
FIG. 7 schematically shows the second tracks of the knife according to the third preferred embodiment of the present invention.

In the third preferred embodiment of the present invention as shown in FIG. 6, the knife 6 is composed of a blade 61, a handle 62, a pushing element 63, and a positioning element 64. For the sake of simplicity, the upper housing and the lower housing of the knife 6 are omitted in FIG. 6 while the first plate 621, the middle housing 622, and the second plate 623 are shown. In this embodiment, the end of the blade 61 that is opposite the blade tip is fastened with a resilient block 610 and at least one projection 611, wherein the resilient block 610 is provided with two resilient elements 610*a* and two engaging portions 610*b*. The pushing element 63 has one end fixedly provided with a pushing key P', and the pushing key P' has one side concavely provided with a receiving groove 630. The positioning element 64 has one end movably positioned in the receiving groove 630 and can move along with the pushing element 63. When the projections 611 and the engaging portions 610*b* are respectively inserted in the first track T1' and the second tracks T2' in the handle 62, the aforesaid end of the positioning element 64 can be moved along the receiving groove 630 so as for the positioning element 64 to engage with the engaging portions 610*b*, thereby fixing the distance between the engaging portions 610*b*. In addition, as shown in FIG. 7, each pair of the corresponding ends of the second tracks T2' are spaced by a first distance D1, and the middle sections of the second tracks T2' are spaced by a second distance D2. Both D1 and D2 are equal to the distance between the engaging portions 610*b*. Furthermore, each second track T2' is provided with a buffer wall 65 adjacent to each of its front end and rear end, and each buffer wall 65 is curved. Each pair of the corresponding buffer walls 65 of the second tracks T2' are spaced by a third distance D3, which is different from the distance between the engaging portions 610*b*. (In this embodiment, the third distance D3 is greater than the distance between the engaging portions 610*b*.) Therefore, once the pushing element 63 drives the engaging portions 610*b* further apart and into contact with a pair of the corresponding buffer walls 65 respectively, the engaging portions 610*b* will move along the buffer walls 65 until the original distance between the engaging portions 610*b* is restored. By keeping the engaging portions 610*b* in a non-deformed state for as long as possible while moving in the second tracks T2', the durability and service life of the engaging portions 610*b* are increased.

Referring back to FIG. 6, the knife 6 further includes a first fixing element 66 and a second fixing element 67. The first fixing element 66 and the second fixing element 67 are fastened to the blade 61. When the first spring S1' and the second spring S2' are positioned in the handle 62, the two ends of the first spring S1' are connected to the first fixing element 66 and the fixing post 621*a* of the first plate 621 respectively, and the two ends of the second spring S2' are connected to the second fixing element 67 and the second plate 623 respectively. Thus, the blade 61 can be driven forward of the handle 62 by the resilient restoring force of the springs S1' and S2', allowing the knife 6 to function in the same way as in the previous embodiments.

What is claimed is:

1. A knife having resilient elements for blade positioning, comprising:

a blade having an end provided with two said resilient elements and a projection, each said resilient element having an end protrudingly provided with an engaging portion;

a handle corresponding in configuration to the blade so as for the blade to be positioned in a receiving space in the handle, the handle being provided longitudinally therein with a first track and two second tracks, all said tracks corresponding in position to the receiving space, wherein the first track further corresponds in position to the projection, and the second tracks further correspond in position to the resilient elements respectively, the projection being movably inserted in the first track, each pair of corresponding ends of the second tracks being spaced by a distance corresponding to a distance between the engaging portions, wherein end sections of the second tracks adjacent to the ends of the second tracks are perpendicular to middle sections of the second tracks respectively, the middle sections of the second tracks are parallel with each other and, when the engaging portions are respectively engaged in said end sections of said second tracks, the engaging portions are hindered from moving along the middle sections of the second tracks, such that the blade is either completely received and positioned in the handle or extended out of and positioned outside the handle; and a pushing element having a first end exposed from the handle and a second end extending into the handle and movably inserted in the first track, the pushing element being provided with two recesses corresponding in position respectively to the engaging portions so as for the engaging portions to be positioned in the recesses respectively, each said recess having two sides each provided with an obliquely extending wall, wherein when the engaging portions are respectively engaged in said pair of corresponding ends of the second tracks and the pushing element is moved along the first track, the engaging portions are respectively pushed by corresponding said obliquely extending walls such that not only are the resilient elements deformed, but also the distance between the engaging portions is adjusted to correspond to a distance between middle sections of the second tracks, thus allowing the engaging portions to move along the second tracks and engaged in said end sections of said second tracks.

2. The knife of claim 1, wherein the pushing element is provided with a positioning groove adjacent to the recesses, the positioning groove corresponding in configuration to the projection so as for the projection to pass through the positioning groove and then be inserted into the first track, the projection being pressed against an end of the positioning groove when the engaging portions are respectively pushed by corresponding said obliquely extending walls.

3. The knife of claim 2, further comprising a positioning element movably inserted in the handle and movable along a longitudinal direction of the handle, the positioning element having a first end exposed from the handle and a second end extending into the handle and corresponding in position to the receiving space, the positioning element being fixedly provided with two retaining portions, the retaining portions corresponding in position respectively to the engaging portions and corresponding in configuration to a cross section of each said engaging portion such that, when the engaging portions are respectively engaged in a pair of corresponding said ends of the second tracks, the retaining portions are respectively engaged with the engaging portions to fix the distance between the engaging portions and thereby prevent the engaging portions from moving along the second tracks.

4. The knife of claim 3, wherein the handle comprises an upper housing and a lower housing, the upper housing and the lower housing being connected together such that the receiving space is formed therebetween, the first track and the second tracks being provided on a side of the upper housing that corresponds in position to the receiving space.

5. The knife of claim 3, wherein the handle comprises an upper housing, a middle housing, and a lower housing, the middle housing being connected between the upper housing and the lower housing such that the receiving space is formed between the upper housing, the middle housing, and the lower housing, the first track and the second tracks being provided on a side of the upper housing that corresponds in position to the receiving space.

6. The knife of claim 4, wherein the upper housing further comprises a first plate, the first plate being fixed to the side of the upper housing that corresponds in position to the receiving space, the first track and the second tracks being provided on the first plate.

7. The knife of claim 5, wherein the upper housing further comprises a first plate, the first plate being fixed to the side of the upper housing that corresponds in position to the receiving space, the first track and the second tracks being provided on the first plate.

8. The knife of claim 6, wherein the lower housing further comprises a second plate, the second plate being fixed to a side of the lower housing that corresponds in position to the receiving space, the second plate being provided with a first auxiliary track and two second auxiliary tracks, the first auxiliary track corresponding in position and configuration to the first track, the second auxiliary tracks corresponding in position and configuration to the second tracks respectively, the pushing element being movably inserted in and movable along the first auxiliary track, the engaging portions being movably inserted in and movable along the second auxiliary tracks respectively.

9. The knife of claim 7, wherein the lower housing further comprises a second plate, the second plate being fixed to a side of the lower housing that corresponds in position to the receiving space, the second plate being provided with a first auxiliary track and two second auxiliary tracks, the first auxiliary track corresponding in position and configuration to the first track, the second auxiliary tracks corresponding in position and configuration to the second tracks respectively, the pushing element being movably inserted in and movable along the first auxiliary track, the engaging portions being movably inserted in and movable along the second auxiliary tracks respectively.

10. The knife of claim 8, further comprising a spring positioned in the handle, the spring having an end connected to the handle and an opposite end connected to the end of the blade such that, when the blade is received in the handle, the spring is stretched and under tension, and when the engaging portions are subsequently disengaged from a corresponding pair of corresponding said ends of the second tracks, the blade is driven outward of the handle by a resilient restoring force of the spring.

11. The knife of claim 9, further comprising a spring positioned in the handle, the spring having an end connected to the handle and an opposite end connected to the end of the blade such that, when the blade is received in the handle, the spring is stretched and under tension, and when the engaging portions are subsequently disengaged from a corresponding pair of corresponding said ends of the second tracks, the blade is driven outward of the handle by a resilient restoring force of the spring.

12. The knife of claim 10, wherein each said second track is provided with a buffer wall adjacent to each said end of the each said track, each pair of corresponding said buffer walls of the second tracks being spaced by a distance different from the distance between the engaging portions.

13. The knife of claim 11, wherein each said second track is provided with a buffer wall adjacent to each said end of the each said track, each pair of corresponding said buffer walls of the second tracks being spaced by a distance different from the distance between the engaging portions.

14. The knife of claim 12, wherein the distance between the middle sections of the second tracks is different from the distance between the engaging portions.

15. The knife of claim 13, wherein the distance between the middle sections of the second tracks is different from the distance between the engaging portions.

16. The knife of claim 14, further comprising a pushing key, the first end of the pushing element being fixed to a side of the pushing key, the side of the pushing key being concavely provided with a receiving groove, the first end of the positioning element being movably positioned in the receiving groove such that, when the engaging portions are respectively positioned at a pair of corresponding said ends of the second tracks, the first end of the positioning element can move along the receiving groove, thereby bringing the retaining portions into engagement with the engaging portions respectively.

17. The knife of claim 15, further comprising a pushing key, the first end of the pushing element being fixed to a side of the pushing key, the side of the pushing key being concavely provided with a receiving groove, the first end of the positioning element being movably positioned in the receiving groove such that, when the engaging portions are respectively positioned at a pair of corresponding said ends of the second tracks, the first end of the positioning element can move along the receiving groove, thereby bringing the retaining portions into engagement with the engaging portions respectively.

18. The knife of claim 16, wherein the resilient elements are fastened to the end of the blade.

19. The knife of claim 17, wherein the resilient elements are fastened to the end of the blade.

* * * * *